United States Patent [19]

Munson et al.

[11] 3,971,032

[45] July 20, 1976

[54] DUAL FREQUENCY MICROSTRIP ANTENNA STRUCTURE

[75] Inventors: Robert E. Munson, Boulder, Colo.; Harold T. Buscher, Oakland, Calif.

[73] Assignee: Ball Brothers Research Corporation, Boulder, Colo.

[22] Filed: Aug. 25, 1975

[21] Appl. No.: 607,418

[52] U.S. Cl. ..... 343/770; 343/846

[51] Int. Cl.[2] ..... H01Q 13/18

[58] Field of Search ..... 343/767, 770, 771, 846, 343/908

[56] References Cited

UNITED STATES PATENTS

| | | | |
|---|---|---|---|
| 3,665,480 | 5/1972 | Fassett | 343/769 |
| 3,757,343 | 9/1973 | Bogner | 343/770 |

*Primary Examiner*—Eli Lieberman

*Attorney, Agent, or Firm*—James D. Haynes

[57] ABSTRACT

A conformal microstrip antenna structure formed by a plurality of separated spaced-apart electrically conducting elements on a dielectric substrate overlying a ground plane. The innermost edges of the separated conducting elements define two sets of two intersecting radiators which are fed by microstrip transmission circuits disposed within the space between the separated conducting elements to individually feed the various radiators and/or segments thereof from the common feed point. The dimensions of the conducting elements also determine the resonant frequency of the radiators and their relative phases such that dual frequency operation as well as circular and/or elliptical polarization of the received/transmitted electromagnetic radiation can be conveniently achieved.

8 Claims, 1 Drawing Figure

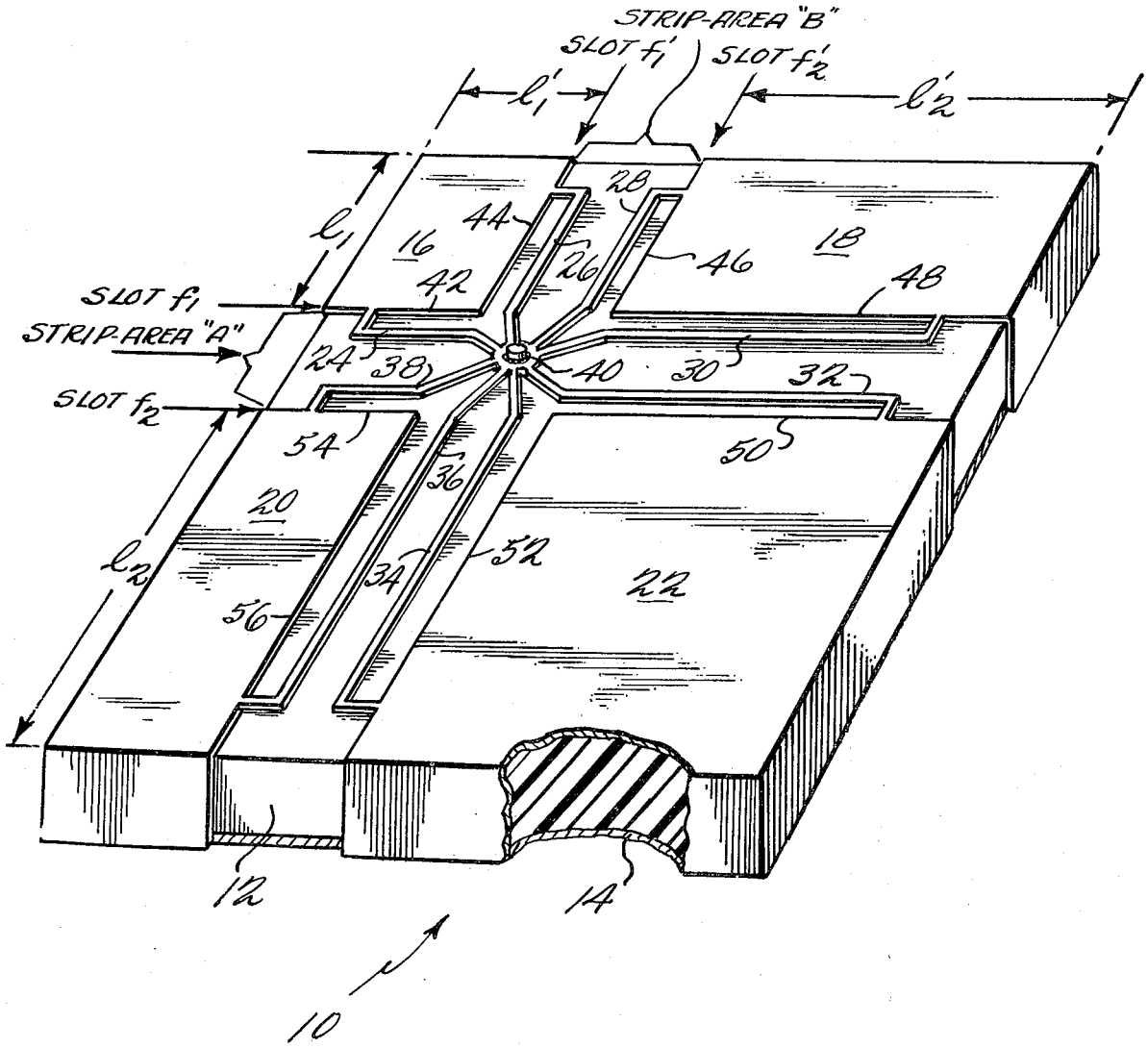
STRIP-AREA "B"
SLOT $f_1'$
SLOT $f_2'$
$l_1'$
$l_2'$
$l_1$
SLOT $f_1$
STRIP-AREA "A"
SLOT $f_2$
$l_2$
16
18
20
22
24
26
28
30
32
34
36
38
40
42
44
46
48
50
52
54
56
12
14
10

DUAL FREQUENCY MICROSTRIP ANTENNA STRUCTURE

This invention relates generally to a dual frequency antenna structure. More particularly, the preferred and exemplary embodiment of such a dual frequency antenna structure is a conformal microstrip antenna structure formed from a conductor-clad dielectric substrate with conventional photo-etching processes similar to those used in the manufacture of printed circuitry. Other types of conformal microstrip antenna structures are disclosed in earlier commonly assigned United States Pat. Nos. 3,713,162; 3,810,183 and 3,811,128 and copending United States application Ser. No. 352,005 filed Apr. 17, 1973, now U.S. Pat. No. 3,921,177.

The general advantage, economy and convenience of microstrip conformal antenna structures, per se, is now accepted in the art. Many such advantages are explained in detail within the above cited commonly assigned prior United States patents and patent applications.

Nevertheless, in spite of the recognized advantages of such microstrip conformal antenna structures, per se, it has not always been thought possible to achieve some specialized antenna performance characteristics with such economical structures. One such "problem area" has been the design of an antenna structure for operation at widely separate frequencies while yet producing wide-angle pattern coverage at each operation frequency.

Now, however, with the discovery of the present invention, a dual frequency microstrip conformal antenna has been discovered wherein electromagnetic radiation may be received and/or transmitted over a wide angle simultaneously at two widely separated frequencies of operation. Furthermore, this same structure advantageously permits circular polarization or any degree of elliptical polarization desired by merely properly sizing the elements of the antenna structure. The exemplary embodiment of the present invention provides a nearly omni-directional pattern in the upper hemisphere (assuming that the antenna structure is aimed upwardly) while simultaneously providing desired elliptical or circularly polarized radiation at widely separated frequencies.

The gain of the antenna structure in the exemplary embodiment is also nearly uniform over the upper hemisphere at both operating frequencies and the degree of circularity or desired ellipticity of polarization is also very good over the entire pattern of the antenna structure.

All these desirable effects have been achieved utilizing the economical microstrip conformal type of antenna structure which is nearly planar, i.e. not thick thus allowing easy retrofit mounting of such structures at low cost on supersonic aircraft, etc., as will be appreciated by those in the art.

While this invention will undoubtedly find many practical applications, it may be used to particular advantage for communication with geostationary satellites which normally operate on two widely separated frequency channels. Furthermore, an adaptation of the exemplary embodiment of the invention permits the extension of a normally narrow bandwidth single frequency microstrip antenna structure by virtue of choosing the two operating frequencies of the exemplary embodiment to be fairly close to one another in frequency. The design parameters for any particular embodiment of the invention may also be selected to produce any desired polarization ellipticity over the antenna pattern for applications where purely circularly polarized radiation is not desired or necessary but where wide band dual frequency wide angle operation is desired in a conformal antenna structure.

While this invention comprises a dual frequency antenna having possibly widely separated frequencies of operation in a circularly or elliptically polarized mode, for purposes of preliminary understanding of the antenna structure operation, it is most convenient to begin by talking about operations at only a single frequency. Accordingly, this brief description will begin by considering only one of the two antenna operating frequencies. At this selected operating frequency, the antenna actually comprises two intersecting radiating slots (each slot includes two aligned segments as will be explained more fully below) fed by microstrip lines from a common feed point located in the plane of and near the intersection of the radiating slots. The relevant dimensions of the two intersecting slots are approximately equal but slightly unequal so as to produce a 90° phase difference between the signals radiated therefrom thus producing a desired circular polarization. By adjusting these relative slot dimensions, one can achieve any desired phase difference between the two intersecting slots and thus achieve any desired ellipticity of polarization.

The second operation frequency for the antenna structure is similarly achieved by two intersecting radiating slots (comprising two segments each) also fed from the same common feed point by microstrip transmission lines. The relative phases for these latter two radiating slots is similarly adjusted as already described with respect to the first operating frequency so as to obtain the desired degree of polarization for the second operating frequency.

The four radiating slots just described comprise two orthogonal slots which operate at a first frequency and an additional two orthogonal slots operating at a second frequency. These slots are very advantageously and compactly arranged on a single conformal microstrip antenna structure which may, to a first order approximation, be visualized as being formed by stripping away the printed circuit conductor material in two orthogonal strips from a square or rectangularly shaped body having shorted edges with the center intersection line of the removed strip areas being offset from the geographic center of the overall structure. The remaining conductive material thereby automatically defines two orthogonal slots (each comprising two aligned slot segments) approximately tuned to a first higher frequency and two complimentary orthogonal slots (each comprising two aligned slot segments) automatically approximately tuned to a second lower operating frequency. Of course, the difference between the two operating frequencies is roughly proportional to the off-centering of the intersection previously discussed. The microstrip feed lines are located in the removed strip area where the conductor surface has been removed and all such microstrip feed lines are connected to a common feed point at the intersection area.

Preferably, the microstrip feed lines comprise one-quarter wavelength impedance transformers which are individually connected to drive appropriate radiating slots at their resonant frequency while simultaneously isolating the non-resonant slots from the common feed point. A standard coaxial connector may be mounted to the backside of the ground plane surface with the center conductor extending through the dielectric substrate of the antenna structure and being electrically connected to the common feed point on the active surface of the antenna.

In the exemplary embodiment, the intersecting radiating slots comprise the inner edges of four spaced-apart conductive elements individually disposed in respectively corresponding corners of the antenna structure thus leaving two intersecting strip areas therebetween. The outer edges of these conductive elements are, in the exemplary embodiment, generally aligned with the outer edges of the dielectric substrate and a conductive short or electrical connection is made to the ground plane along the entire outer edges of the conductive elements. In this manner, the volume bounded by the ground plane and any one of the separate conductive elements overlying the the dielectric substrate defines a resonant cavity (loaded by the dielectric substrate) of shorted wave guide section of proper electrical length (measured transversely to the inner edge comprising the radiating slot segment under discussion) so as to provide a low resistance and zero reactance at the radiating slot. In the exemplary embodiment, each intersecting radiating slot actually comprises two aligned radiating slot segments tuned to the same frequency and phase formed by adjacent spaced apart conductor elements so as to produce a composite radiating slot. For circularly polarized operation, one of such orthogonally situated composite radiating slots would be adjusted in effective electrical cavity length so that there would be a 90° phase difference between currents at the two orthogonally situated slots. The same kind of adjustment could also be used for the complimentary orthogonal slots tuned to the second frequency of operation.

A more complete understanding of this invention, of its advantages and operations and of the preferred exemplary embodiment will be had by reference to the following detailed description taken in conjunction with the drawing in which a pictorial schematic representation of a preferred exemplary embodiment is given.

Referring to the drawing, the antenna structure is generally shown at 10. It may be formed from a conductively clad dielectric substrate 12. As shown, the dielectric substrate 12 is clad on its underside by a conductive ground plane surface 14 and on its upper surface by a plurality of spaced-apart conductive elements 16, 18, 20, 22 and microstrip conductors 24, 26, 28, 30, 32, 34, 36 and 38 as well as a common input-/output electrical connection 40. The outer edges of elements 16, 18, 20 and 22 are electrically shorted to ground plane 14. The drawing schematically shows all conductors as integral and unitary although some conductor portions may actually be soldered, etc., as will be appreciated. Although the exemplary embodiment shown in the drawing is a substantially planar configuration, those in the art will recognize that such antenna surfaces are actually often conformed to a non-planar surface such as the contour of a supersonic aircraft, missile, etc.

The four conducting elements 16, 18, 20 and 22 shown in the exemplary embodiment are substantially quadrangularly shaped elements having an individual and combined area size smaller than the size of the underlying ground surface 14 and dielectric layer 12. Furthermore, each of the four conductive elements 16, 18, 20 and 22 is individually disposed at a respectively corresponding one of the four corners of the underlying dielectric layer thereby leaving intersecting strips areas A and B as the generally exposed contiguous inner area of the dielectric layers.

It will also be noted from the drawing that in the exemplary embodiment the two outer edges of each of the four elements 16, 18, 20 and 22 are substantially aligned with the corresponding outer edges of the dielectric layer 12 and are thereat electrically connected to the ground surface 14 and at the upper side by one of the conductive elements 16–22. The inner edges of the elements 16–22 then comprise electromagnetic radiating slots with the resonant frequency of each such slot being determined, at least in part, by the magnitude of the distance between the inner slot edge and its respectively associated oppositely situated outer edge shorted to the ground surface 14.

Thus, edge 42 of element 16 comprises a radiating slot having a resonant frequency $f_1$ determined, at least in part, by dimension $l_1$. At the same time, inner edge 44 of element 16 defines a radiating slot with an operating resonant frequency of $f_1'$ determined, at least in part, by dimension $l_1'$. Similarly, inner edge 46 of element 18 comprises a radiating slot having a resonant frequency $f_2'$ determined, at least in part, by dimension $l_2'$. Inner edge 48 of element 18 also comprises a radiating slot of frequency $f_1$ as determined, at least in part, by dimension $l_1$. As should now be appreciated, edges 42 and 48 are actually in alignment or substantial alignment and act as a composite radiating slot.

Similar analysis could also be made of the radiating slots comprising inner edges 50 and 52 of element 22 and inner edges 54 and 56 of element 20. Accordingly, as should now be appreciated, inner edges 42 and 48 act as a composite radiating slot tuned to frequency $f_1$ while edges 44 and 46 act as a composite radiating slot tuned to frequency $f_1'$. Thus, there is defined a slot $f_1$ and a slot $f_1 f_{a\ slot\ f1}'$ which intersect at substantially 90°. Furthermore, if the dimensions $l_1$ and $l_1'$ are made slightly different, then different relative phase relationships will exist between the current at slots $f_1$ and $f_1'$. For circular polarization such phase differences would be designed to be substantially 90° with the relative leading or lagging relationship depending upon whether one desires to achieve left-hand or right-hand circularly polarized radiation. It should also be apparent by now that other degrees of elliptical polarization can be obtained by adjusting the relative dimensions $l_1$ and $l_1'$ since circular polarization is only a special case of elliptical polarization and since any desired relative phase adjustment may be obtained by adjusting the relative dimensions $l_1$ and $l_1'$.

At the same time, inner edges 50 and 54 comprise a composite radiating slot for frequency $f_2$ while inner edges 46 and 52 comprise a composite radiating slot for frequency $f_2'$. Here again, the relative dimensions of $l_1$ and $l_2'$ may be adjusted to produce desired phase differences between electrical currents at slots $f_2$ and $f_2'$ so as to obtain any desired degree of ellipticity of polarization.

Thus, slots $f_1$ and $f_1'$ constitute first and second intersecting means for transmitting/receiving electromagnetic waves of a first predetermined frequency while slots $f_2$ and $f_2'$ constitute third and fourth intersecting means for transmitting/receiving electromagnetic waves of the second predetermined frequency.

The microstrip electrical conductors 24–38 are also disposed on top of the dielectric layer 12 and within the intersecting strip areas A and B to define transmitting-/receiving electrical transmission circuits connected individually to the radiating slots $f_1$, $f_1'$, $f_2$ and $F_2'$ and connected in common to the input/output electrical connection 40. The microstrip conductors shown in the drawing are not to scale and are intended to be schematic representations only. In actual practice, it is preferred that the microstrip conductors comprise one-quarter wavelength impedance transformers for coupling to the particular respectively associated slots at the respectively associated resonant frequency thereof while simultaneously acting to electrically isolate all non-resonant slots from the common input/output electrical connection 40.

For example, the non-resonant slots would present a virtual short circuit at their edges which would be reflected to feed point 40 as an open circuit through microstrip conductors designed to operate as quarter wavelength transformers. Similarly, the resonant slots would present a small resistance at their edges (e.g. 100 ohms) which would be reflected to feed point 40 as corresponding small parallel connection resistances (e.g. 200 ohms) which match the impedance of a connected coaxial feed line (e.g. 50 ohms) through microstrip conductors designed to operate as quarter wavelength transformers.

Although only the tip of the center conductor is seen from the perspective of the drawing, the preferred exemplary embodiment also includes a radio frequency coaxial connector with the outer coaxially connection being electrically connected to the ground plane 14 and the inner coaxially connection as shown being connected to the common input/output feed point at 40 through an aperture therebeneath within the dielectric layer 12 and the ground plane surface 14. This coaxial connector is thus directed away from the ground plane surface 14 on the side opposite from the dielectric layer 12 thereby providing a convenient means for coupling electrical transmission lines to the antenna structure through its back or inactive side.

As should now be appreciated, the effective resonant cavity length measured from an inner edge surface to an oppositely situated grounded outer edge is selected to be of proper length for providing low resistance and zero reactance at the slot itself. As will be appreciated by those in the art, the actual physical dimensions involved will depend upon the dielectric loading and/or other conventionally considered factors.

Although only a single exemplary embodiment has been described in detail above, those skilled in the art will appreciate that many possible variations and modifications of the exemplary embodiment may be made without materially departing from the novel teachings and advantages of the invention that has been described. Accordingly, all such modifications and variations are intended to be included within the scope of this invention as defined by the appended claims.

What is claimed is:

1. A dual frequency antenna structure comprising:

an electrically conducting ground surface;

a dielectric layer extending on top of said ground surface;

a plurality of separated electrically conducting elements disposed on top of said dielectric layer in a spaced-apart configuration leaving intersecting strip areas therebetween and defining:

first and second intersecting means for transmitting-/receiving electromagnetic waves of a first predetermined frequency, and third and fourth intersecting means for transmitting-/receiving electromagnetic waves of a second predetermined frequency, input/output electrical connection means disposed on top of said dielectric layer within said intersecting strip areas, and microstrip electrical conductors also disposed on top of said transmitting/receiving layer within said intersecting strip areas, said conductors defining transmitting/receivving electrical transmission circuits connected individually to said first, second, third and fourth intersecting means and connected in common to said input/output electrical connection means.

2. A dual frequency antenna structure as in claim 1 wherein:

said ground surface and said dielectric layer are of substantially similar quadrangular sizes and shapes, said plurality of separated conducting elements comprise four substantially quadrangularly shaped elements of individual and combined area sizes smaller than the size of said ground surface and dielectric layer, each of said four elements being individually disposed at a respectively corresponding one of the four corners of said dielectric layer thereby leaving said intersecting strip areas as the contiguous inner area of the dielectric layer still generally exposed.

3. A dual frequency antenna structure as in claim 2 wherein:

two edges of each of said four elements, which two edges are substantially aligned with the outer edges of said dielectric layer, are thereat electrically connected to said ground surface so as to define at least one dielectric loaded resonant cavity, an electromagnetic radiating slot associated with each inner edge of said elements, the resonant frequency of each slot being determined, at least in part, by the magnitude of the distance between an inner slot edge and its respectively associated oppositely situated outer edge connected to said ground surface.

4. A dual frequency antenna structure as in claim 3 wherein:

said first intersecting means comprises a first inner edge of a first one of said elements and an aligned first inner edge of a second one of said elements;

said second intersecting means comprises a second inner edge of said first element and an aligned first inner edge of a third one of said elements;

said third intersecting means comprises a second inner edge of said third element and an aligned first inner edge of a fourth one of said elements; and said fourth intersecting means comprises a second inner edge of said second element and an aligned second inner edge of said fourth element.

5. A dual frequency antenna structure as in claim 4 wherein said elements are dimensioned so as to make the first and second intersecting means to be out-of-phase by a predetermined amount with respect to each other and so as to make the third and fourth intersecting means to be out-of-phase by a predetermined amount with respect to each other.

6. A dual frequency antenna structure as in claim 4 wherein a separate one of said microstrip conductors is provided for feeding each of the eight inner edges of said elements.

7. A dual frequency antenna structure as in claim 6 wherein said input/output connection means is a single common connection and wherein each of said microstrip conductors comprises a one-quarter wavelength impedance transformer for coupling to particular slots at the respectively associated resonant frequency while simultaneously acting to electrically isolate all non-resonant slots from said common connection.

8. A dual frequency antenna structure as in claim 7 further comprising:

a coaxial radio frequency electrical connector means having an inner conductor electrically connected to said common connection through an aperture therebeneath in said dielectric layer and in said ground surface, said coaxial connector means also having an outer conductor electrically connected to said ground surface, and said coaxial connector means being directed away from said ground surface on the side opposite said dielectric layer thereby providing a convenient means for coupling electrical transmission lines to the antenna structure through its back or inactive side.

* * * * *